US005396147A

United States Patent [19]

Lee

[11] Patent Number: 5,396,147

[45] Date of Patent: Mar. 7, 1995

[54] CATHODE HEATER STRUCTURE OF AN ELECTRIC GUN FOR A CATHODE-RAY TUBE AND METHOD OF ASSEMBLING THE HEATERS

[75] Inventor: Soung H. Lee, Kyungsangbuk, Rep. of Korea

[73] Assignee: Goldstar Co., Ltd., Seoul, Rep. of Korea

[21] Appl. No.: 59,663

[22] Filed: May 12, 1993

[30] Foreign Application Priority Data

May 12, 1992 [KR] Rep. of Korea ..... 8016/1992

[51] Int. Cl.[6] ..... H01J 29/04

[52] U.S. Cl. ..... 313/446; 313/337

[58] Field of Search ..... 313/337, 346, 270, 274, 313/446, 458; 219/201, 383

[56] References Cited

FOREIGN PATENT DOCUMENTS 2654554 6/1978 Germany ..... 313/446

0017535 1/1982 Japan ..... 313/337

*Primary Examiner*—Edward L. Coles, Sr.

*Assistant Examiner*—Jerome Grant, II

*Attorney, Agent, or Firm*—Fish & Richardson

[57] ABSTRACT

This invention provides a method of positioning and assembling in place cathode heaters of an electron gun for a cathode-ray tube, thereby resulting in improvements in assembling workability and in the white balance characteristic on the screen of the tube. A cathode heater structure includes a cathode heater and a heater supporter. The cathode heater includes a heat generating portion and a pair of leg portions extending from the heat generating portion. Each leg portion is formed with a bent engaging portion at its end. The heater supporter has guide grooves for receiving the engaging portions of the cathode heater to guide and position them. According to the method of the present invention, the cathode heaters are shot in sequence into the guide grooves of the heater supporter by means of shooters, and then the leg portions of the heaters caught and positioned in the guide grooves are welded to the guide grooves.

5 Claims, 8 Drawing Sheets

CATHODE HEATER STRUCTURE OF AN ELECTRIC GUN FOR A CATHODE-RAY TUBE AND METHOD OF ASSEMBLING THE HEATERS

BACKGROUND OF THE INVENTION

FIELD OF THE INVENTION

This invention relates to a cathode heater structure of an electron gun for a cathode-ray tube and a method of assembling the cathode heaters, and particularly a method of automatically positioning and assembling the cathode heaters of an electron gun.

DESCRIPTION OF THE PRIOR ART

Generally, an electron gun for a color picture tube comprises a stem 1 for applying voltage from the exterior of the gun, three cathode heaters 3 mounted in a row adjacently to the stem 1 and transversely of the gun through a heater supporter 2, three cathode assemblies 5 containing the respective cathode heaters 3 and supported in a row on bead glasses 12 through a cathode supporter 4, and first, second, third, fourth, fifth and sixth electrodes 6,7,8,9,19,11 disposed in order ahead of the cathode assemblies 5 and secured to the opposed bead glasses 12, as shown in FIG. 1 of the accompanying drawings.

Here, as shown in FIG. 2, each cathode assembly 5 comprises a tubular cathode sleeve 5*a* within which the cathode heater 3 is disposed to generate heat, and a cathode cap 5*b* having on its top thermion emission material such as barium carbonate. Each cathode heater 3 comprises a coiled heat generating portion 3*a* located in the cathode sleeve 5*a* of each cathode assembly 5, and a pair of leg portions 3*b* extending divergently from both sides of one end of the heat generating portion 3*a*.

With this construction, when voltage from the exterior of the electron gun is applied to the stem 1, the cathode heaters 3 in the cathode assemblies 5 generate heat, which is in turn transferred to the cathode caps 5*b* mounted at the upper ends of the cathode sleeves 5*a* of the cathode assemblies 5, so that thermions are emitted from the cathode caps having barium carbonate. Then, as the thermions pass through a plurality of the electrodes 6–11, they are accelerated, controlled and converged to form electron beams of a given shape. The electron beams land on a fluorescent screen coated with color phosphors, thereby developing a picture image. Thus, in order to obtain a picture image of good quality on the screen it is required to accurately secure the cathode heaters 3 in the respective cathode assemblies 5 to the bead glasses 12 in consideration of the pitch S of the R,G, and B electron beam passage apertures of each electrode of the color picture tube.

A process of assembling the cathode heaters of the electron gun for the color picture tube according to a prior art will now be described with reference to FIGS. 2 to 4 of the accompanying drawings.

First, as shown in FIGS. 2 and 3, the heat generating portions 3*a* of the three cathode heaters 3 are each inserted into each of the three cathode assemblies 5 arranged in a row at one side of the electron gun. Then, after the distance L between the leading end of the heat generating portion 3*a* of each cathode heater 3 and a welding point P on each leg portion 3*b* of the heater, which will be hereinafter referred to as a "welding point distance", and the pitch S of the electron beam passage apertures of each electrode have been set manually by the aid of a microscope, the leg portions 3*b* of the cathode heaters 3 are welded to longitudinally extending ridges 2*a* formed on the thin plate type heater supporter 2.

This prior assembling process however has a drawback in that since the cathode heaters 3 are manually assembled to the heater supporter 2, it is difficult to accurately set the welding point distance L shown in FIG. 3, and thereby deviation of the welding points P on the leg portions 3*b* of the heater from the horizontal line perpendicular to the center line of the electron beam passage aperture, may occur as indicated by the distance R in FIG. 4, causing adverse effects on the development of a picture image on the screen. More specifically, when the cathode caps 5*b* disposed at the Upper ends of the cathode assemblies 5 are heated by the cathode heaters 3 to emit thermions, the variation of the welding point distance L or existence of the deviation distance R may lead to temperature differences at the upper ends of the cathode assemblies. Then, the temperature differences influence the amount of electron beams emitted, resulting in an adverse effect on a picture image, such as white unbalance phenomenon of a color picture tube. Further, the manual assemblage is fairly labor-intensive and consequently time-consuming task, resulting in lower productivity.

SUMMARY OF THE INVENTION

With the foregoing drawbacks of the prior art in view, the present invention is able to automatically, accurately position and assemble the cathode heater to a heater supporter at predetermined positions.

According to one aspect of the present invention a cathode heater structure disposed in a respective cathode assembly of an electron gun for a color picture tube and secured to opposite bead glasses together with electrodes comprises a cathode heater including a heat generating portion and a pair of leg portions extending from the heat generating portion and each formed at its end with a bent engaging portion; and a heater supporter having a plurality of guide grooves which position the leg portions.

According to another aspect of the present invention, a method of assembling cathode heaters comprises the use of heater shooters each having an interior cavity for containing the cathode heater and an opening for discharging the heater shot against a heater supporter.

DETAILED DESCRIPTION OF THE INVENTION.

The invention will now be described in detail, by way of example, with references to FIGS. 5 to 10 of the accompanying drawings.

Figure 1:
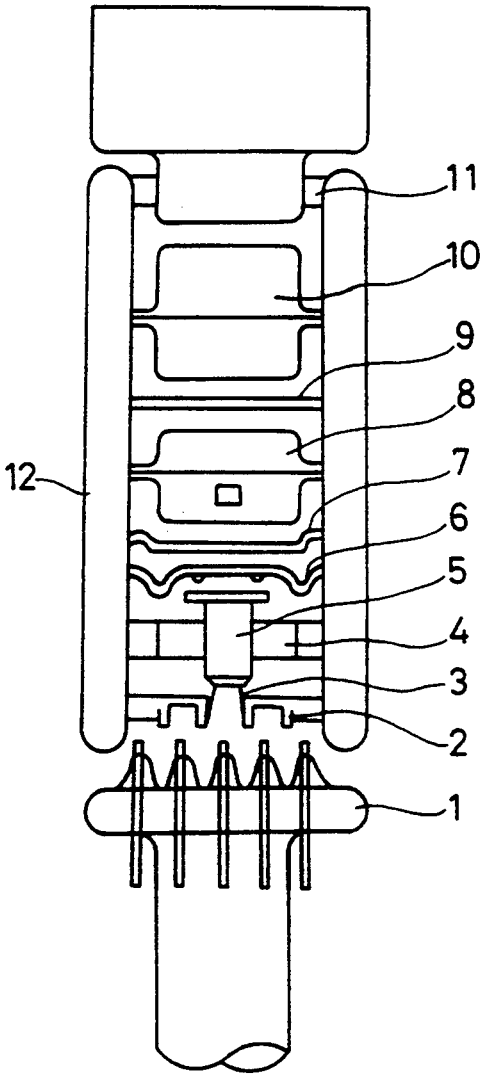
F I G. 1 PRIOR ART
FIG. 1 is a schematic view of a conventional electron gun for a color picture tube.
Figure 2:
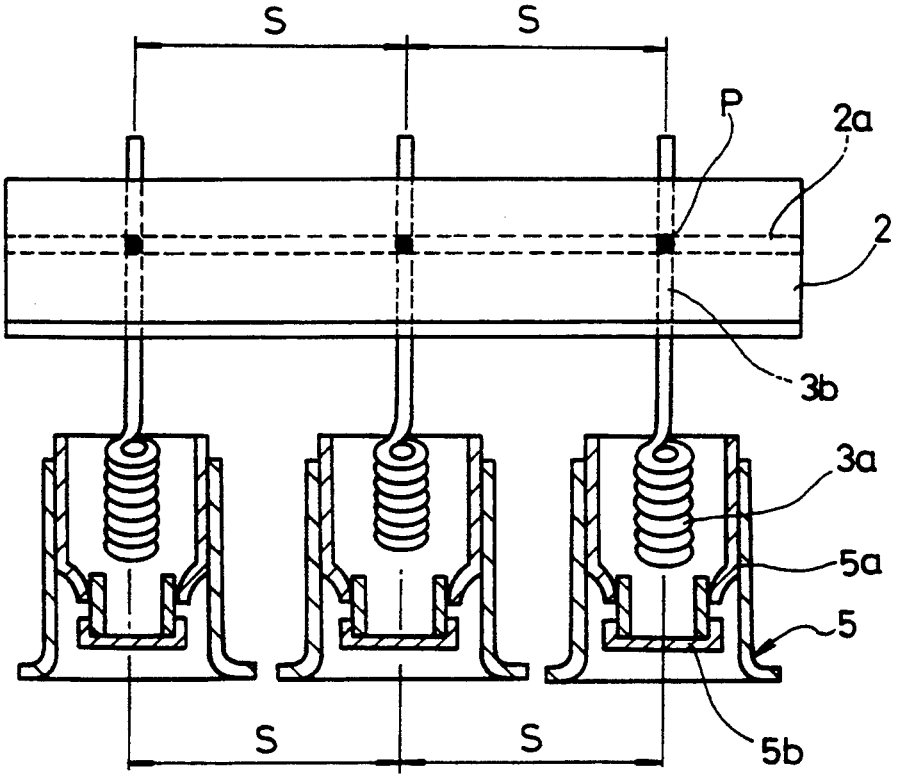
F I G. 2 PRIOR ART
FIG. 2 is an enlarged cross-sectional view of three cathode assemblies of the gun of FIG. 1, showing a cathode heater disposed one in each cathode assembly and welded to a heater supporter.
Figure 3:
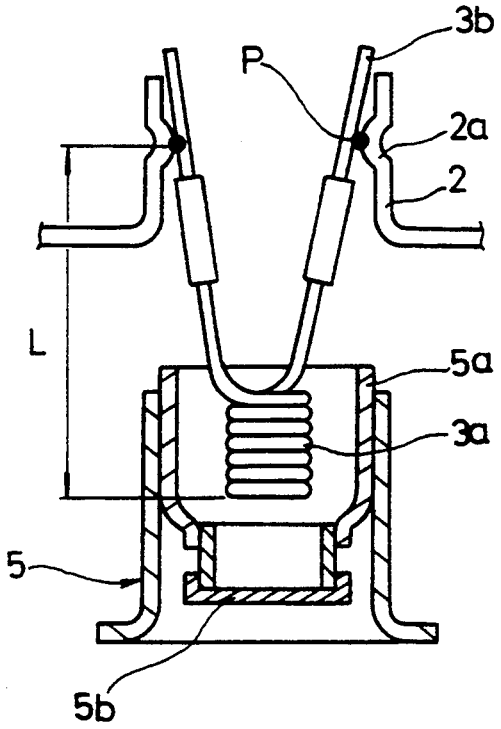
F I G. 3 PRIOR ART
FIG. 3 is a side view illustrating one of the cathode heaters of FIG. 2, with the cathode assembly shown in section.
Figure 4:
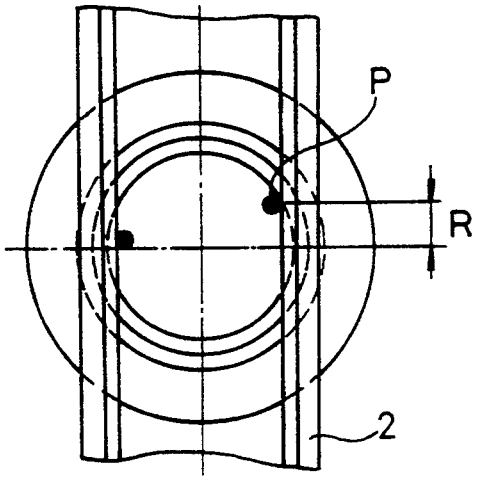
F I G. 4 PRIOR ART
FIG. 4 is a plan view of the cathode heater shown in FIG. 3.
Figure 5:
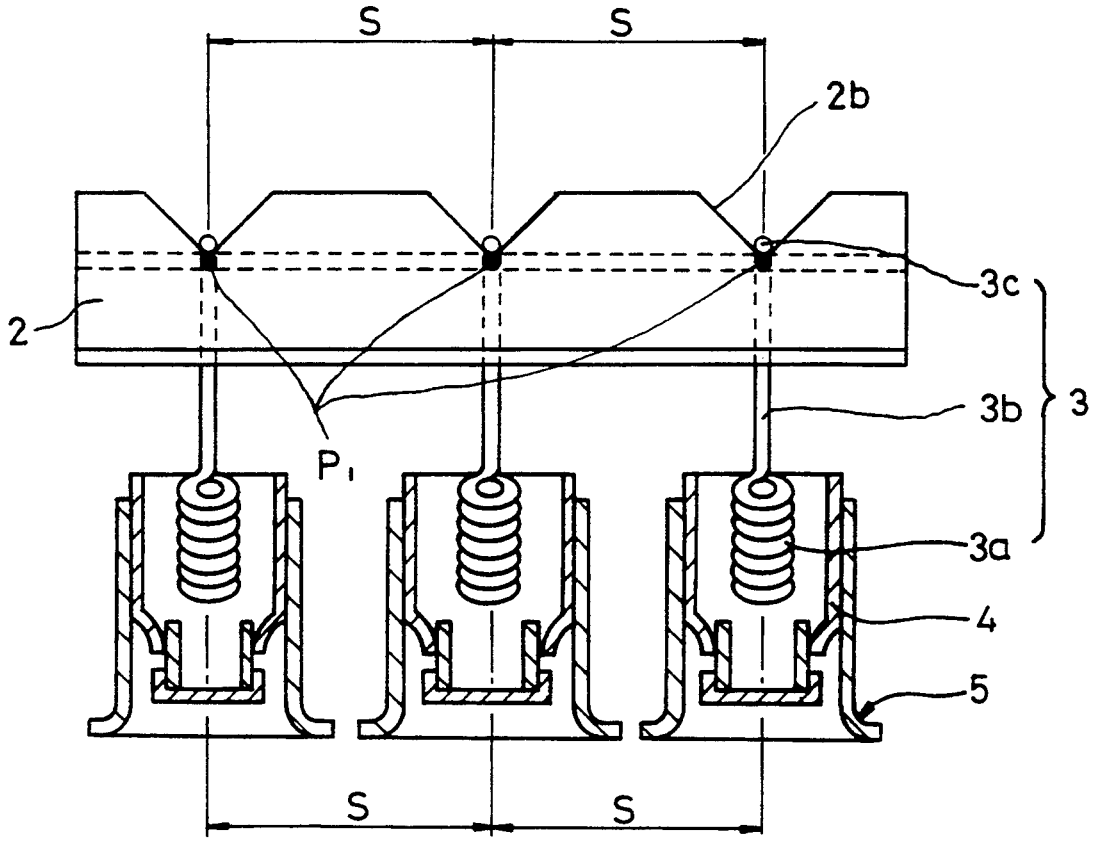
FIG. 5 is an enlarged cross-sectional view similar to FIG. 2, but showing three cathode heaters according to the present invention assembled in a row to a heater supporter.
Figure 6:
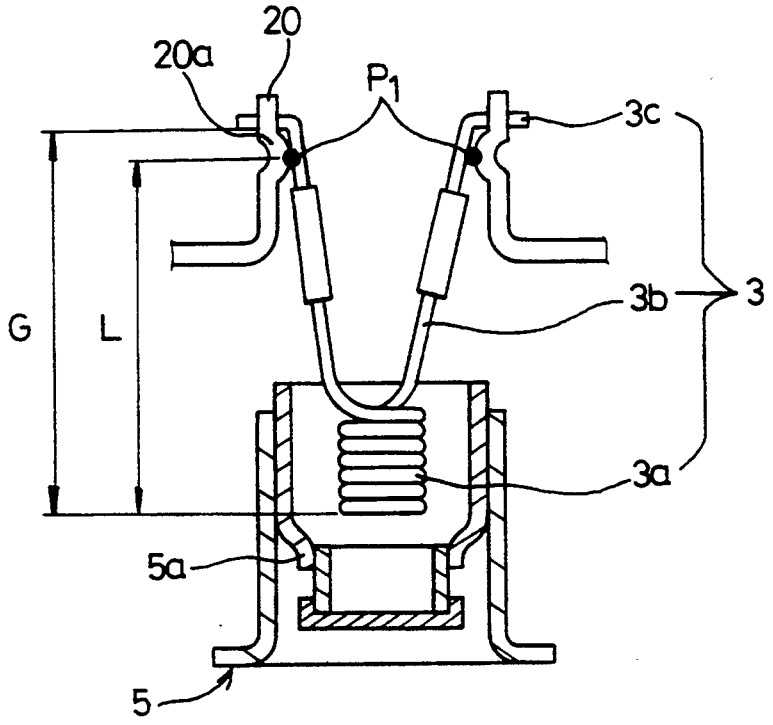
FIG. 6 is a side view showing the cathode heater of the present invention assembled to the heater supporter.
Figure 8A:
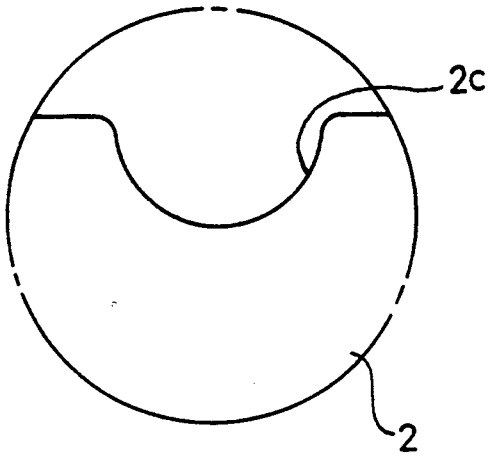
FIGS. 8*a* and 8*b* are views showing different shapes of a guide groove formed in the heater supporter according to the present invention.
Figure 8B:
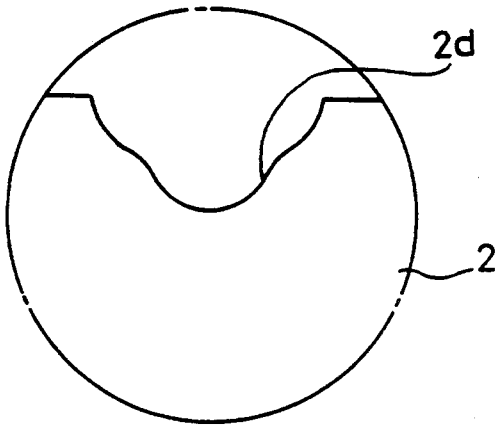

Referring to FIGS. 5 and 6, the present invention provides a method of assembling in place three cathode heaters 3, which are disposed on in each of three cathode assemblies 5 arranged in a row transversely of an electron gun, by using a heater supporter 2 having a plurality of pairs of guide grooves 2*b* formed therein to correspond in number to the number of the cathode assemblies 5 and the guide and position leg portions 3*b* of the cathode heaters 3. The guide grooves 2*b* of the heater supporter 2 are disposed at predetermined intervals corresponding to the distances S between the longitudinally extending lines passing through the centers of the R, G and B electron beam passage apertures of electrodes (not shown). Each guide groove has a deepest bottom at its central portion. The shape of each guide groove is not restricted to a triangular shape as shown in FIG. 5, but may be any of various shapes including a single circular arc 2*c* as shown in FIG. 8*a* and a multiple arc 2*d* comprised of a plurality of circular arcs as shown in FIG. 8*b*.

The cathode heater 3 on the present invention has engaging portions 3*c* formed by bending the ends of the leg portions 3*b* to be engaged with the guide groove 2*b* of the heater supporter 2. At this time, the bending positions of the leg portions of the cathode heater are determined in design in consideration of the distance G between the leading of a heat generating portion 3*a* of the heater and the deepest central bottom of each guide groove 2*b* of the heater supporter.

Figure 10A:
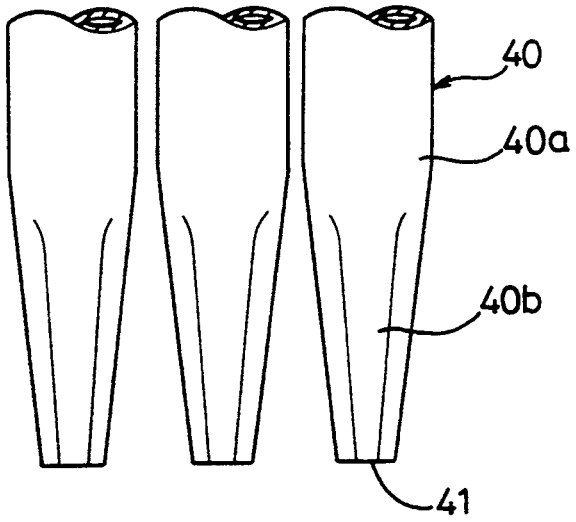
FIGS. 10*a* and 10*b* are front and side views of a heater shooter used in the present invention.
Figure 10B:
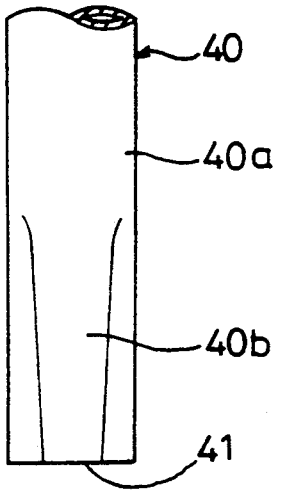
Figure 11:
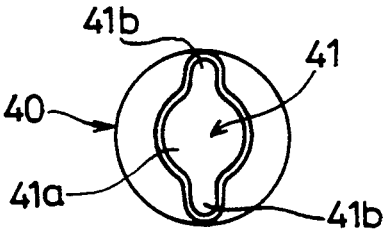
FIG. 11 is a bottom view of the heater shooter used in the present invention.

Referring to FIGS. 10*a*, 10*b* and 11 which respectively show front, side and bottom views of a heater shooter for feeding the cathode heaters to the heater supporter, the heater shooter 40 according to the present invention is made of a tubular member comprising a hollow cylindrical body 40*a* and an outlet portion 40*b* formed at one end of the cylindrical body 40*a* to have a progressively decreasing cross-section. As shown in FIG. 11, an outlet opening 41 of the outlet portion 40*b* is comprised of a central opening portion 41*a* of a larger diameter through which the heat generating portion 3*a* of the cathode heater 3 passes during feeding operation, and two side opening portions 41*b* of a smaller diameter which are provided at the opposite sides of the periphery of the central opening portion 41*a* to be in communication with the central portion and through which the leg portions 3*b* of the cathode heater pass during the feeding operation. In cathode heater assembling operation, the shooters 40 are used with three shooters joined together to make a set.

A process of assembling the cathode heaters for the electron gun according to the present invention will now be explained with reference to the drawings.

First, the cathode heaters 3 are put into the heater shooters 40 with the heat generating portion 3*a* of each heater positioned within the larger central opening portion 41*a* of each shooter and with the leg portions 3*b* of each heater positioned within the smaller side opening portions 41*b* of each shooter. At this time, the heater is loaded into the shooter 40 with the heat generating portion 3*a* thereof facing forwardly.

Figure 7:
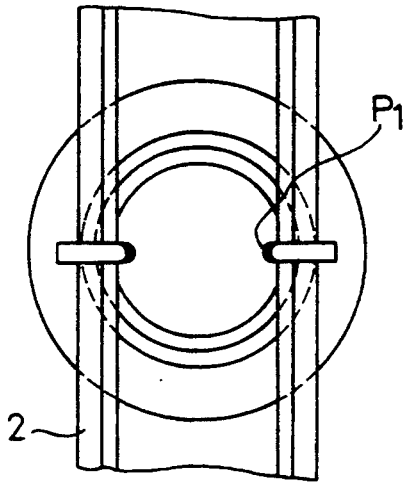
FIG. 7 is a plan view of the cathode heater shown in FIG. 6.
Figure 9:
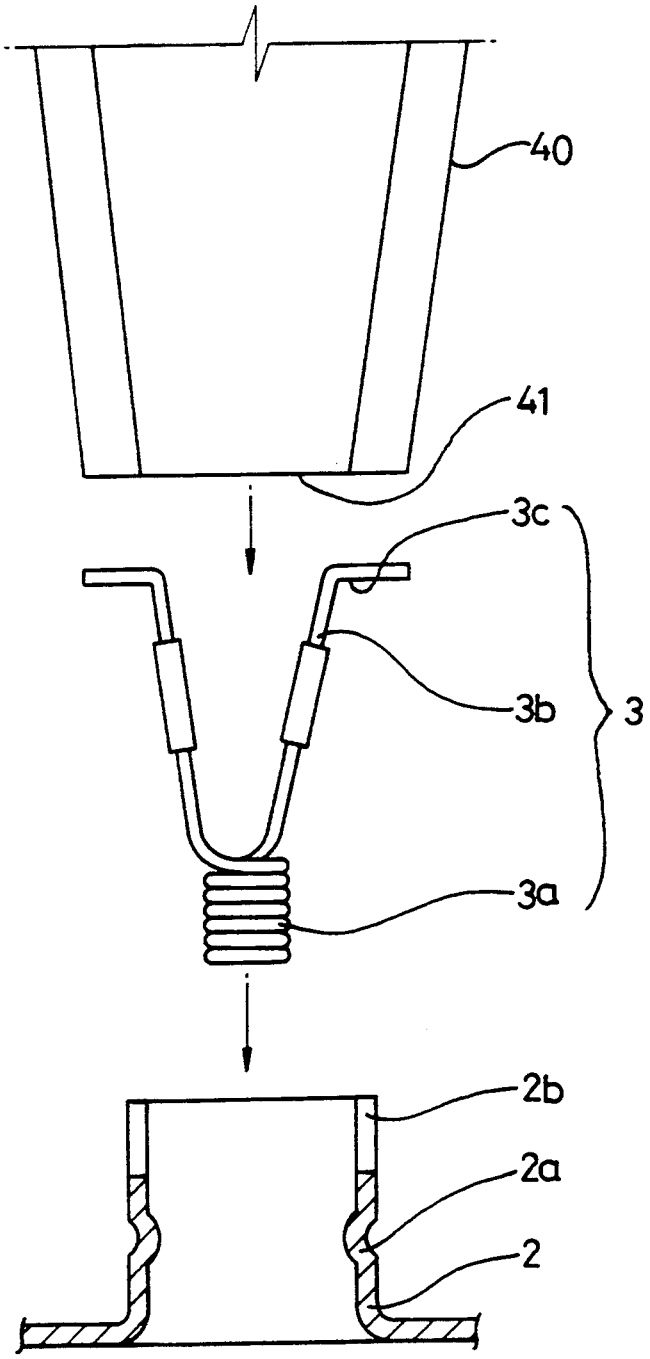
FIG. 9 is a view explaining the operation of assembling the cathode heater to the heater supporter in accordance with the present invention.

Then, as shown in FIG.9, the heaters 3 contained in the shooters 40 are shot in the direction of the arrow (downwardly as viewed in the drawing) through the outlet openings 41 of the shooters such the engaging portions 3*c* of the leg portions 3*b* of the heaters are inserted into the guide grooves 2*b* of the heater supporter 2. Then, as the heaters 3 caught in the guide groove 2*b* of heater supporter are slid down by their own gravity to rest on the deepest central bottoms of the guide grooves, each of the heaters is disposed accurately symmetrically with respect to each of the longitudinally extending lines passing through the centers of the R, G and B electron beam passage apertures of the electrodes, as shown in FIG. 7. At this time, since the engaging portions 3*c* of each cathode heater 3 are bent at the points corresponding to the predetermined distance G between the leading end of the heat generating portion 3*a* of the heater and the deepest bottom of each guide groove 2*b* of the heater supporter 2, the welding point distance L between welding point $P_1$ of each leg portion 3*b* of the heater and the leading end of the heat generating portion 3*a* can be always kept constant.

Finally, assembly is completed by welding the thus aligned leg portions 3*b* of the heater 3 to ridges 2*a* of the heater supporter 2 at the welding points $P_1$.

From the foregoing it will be appreciated that according to the present invention, since the cathode heaters can be automatically supplied by means of the shooters, and then guided and secured in place by the suitably shaped guide grooves of the heater to be accurately assembled to the supporter, an improvement in assembling workability and a reduction in assembling tolerance can be achieved. As a result, white unbalance occurring on the screen of the color picture tube is reduced, resulting in enhanced product quality.

While the invention has been shown and described with particular reference to an embodiment thereof, it will be understood that variations and modifications may be made therein without departing from spirit and scope of the invention as defined in the appended claims.

What is claimed is:

1. A cathode heater structure disposed in a respective cathode assembly of an electron gun for a color picture tube and secured to opposite bead glasses together with electrodes, the heater structure comprising:

a cathode heater comprising a heat generating portion having two ends and a pair of leg portions extending from one end of said heat generating portion, each leg portion formed with a bent engaging portion at its end; and a heater supporter having a plurality of guide grooves for receiving said engaging portions of said cathode heater to guide and position them, wherein said engaging portions of said cathode heater are formed by bending said leg portions in conformity with the distance between the other end of the heat generating portion and each of said guide grooves of said heater supporter.

2. A cathode heater structure disposed in a respective cathode assembly of an electron gun for a color picture tube and secured to Opposite bead glasses together with electrodes, the heater structure comprising:

a cathode heater comprising a heat generating portion having two ends and a pair of leg portions extending from one end of said heat generating portion, each leg portion formed with a bent engaging portion at its end; and a heater supporter having a plurality of guide grooves for receiving said engaging portions of said cathode heater to guide and position them, wherein said guide grooves of said heater supporter are formed at predetermined intervals to correspond to the number of R, G, and B electron beam passage apertures of each of said electrodes and each of said guide grooves have a deepest bottom at its central portion.

3. A cathode heater structure disposed in a respective cathode assembly of an electron gun for a color picture tube and secured to opposite bead glasses together with electrodes, the heater structure comprising:

a cathode heater comprising a heat generating portion having two ends and a pair of leg portions extending from one end of said heat generating portion, each leg portion formed with a bent engaging portion at its end; and a heater supporter having a plurality of guide grooves for receiving said engaging portions of said cathode heater to guide and position them, wherein said guide grooves of said heater supporter have shapes including a triangular shape, a circular arc shape and a combined shape of circular arcs to provide smooth sliding and guiding of said leg portions of said heater.

4. A method of assembling cathode heaters of an electron gun for a color picture tube, comprising the steps /$_o$f:

providing heater feeding means for feeding said cathode heaters each having a heat generating portion and a pair of leg portions;

shooting in sequence said heaters into guide grooves of a heater supporter by using said heater feeding means; and securing said leg portions of said heaters caught in said guide grooves of said heater supporter, wherein said heater feeding means has an outlet portion having a progressively decreasing cross-section and provided with an outlet opening comprising a central opening portion of a larger diameter through which said heat generating portion of each said heater passes during the shooting, and two side opening portions of a smaller diameter which are provided at the opposite sides of the periphery of said central opening portion to be in communication with said central portion and through which said leg portions of each said heater pass.

5. A method of assembling cathode heaters of an electron gun for a color picture tube, comprising the steps of:

providing heater feeding means for feeding said cathode heaters each having a heat generating portion and a pair of leg portions;

shooting in sequence said heaters into guide grooves of a heater supporter by using said heater feeding means; and securing said leg portions of said heaters caught in said guide grooves of said heater supporter, wherein said step of securing said leg portions comprises welding said leg portions to said heater supporter.

* * * * *